US011619230B2

(12) United States Patent
Park et al.

(10) Patent No.: US 11,619,230 B2
(45) **Date of Patent: *Apr. 4, 2023**

(54) VANE ROTARY COMPRESSOR

(71) Applicant: LG ELECTRONICS INC., Seoul (KR)

(72) Inventors: Joonhong Park, Seoul (KR); Kiyoul Noh, Seoul (KR); Seokhwan Moon, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/502,098

(22) Filed: Oct. 15, 2021

(65) Prior Publication Data

US 2022/0034318 A1 Feb. 3, 2022

Related U.S. Application Data

(63) Continuation of application No. 16/541,260, filed on Aug. 15, 2019, now Pat. No. 11,174,863.

(30) Foreign Application Priority Data

Nov. 16, 2018 (KR) ..... 10-2018-0142076

(51) Int. Cl.
*F04C 18/344* (2006.01)
*F04C 29/02* (2006.01)
(Continued)

(52) U.S. Cl.
CPC ..... *F04C 18/344* (2013.01); *F04C 29/00* (2013.01); *F04C 29/023* (2013.01);
(Continued)

(58) Field of Classification Search
CPC .... F01C 21/0845; F01C 21/0809–0872; F04C 18/344–352; F04C 2240/50; F04C 29/00; F04C 29/023; F04C 2230/602
See application file for complete search history.

(56) References Cited

U.S. PATENT DOCUMENTS 716,503 A * 12/1902 Whitaker ..... F01C 21/0845 418/266
2,189,088 A * 2/1940 Thompson ..... F01C 19/08 418/268

(Continued)

FOREIGN PATENT DOCUMENTS

CN 102844525 12/2012
CN 104321534 1/2015

(Continued)

*Primary Examiner* — Mark A Laurenzi
*Assistant Examiner* — Xiaoting Hu
(74) *Attorney, Agent, or Firm* — Birch, Stewart, Kolasch & Birch, LLP

(57) ABSTRACT

A vane rotary compressor includes a roller rotatably supported in a cylinder and including a plurality of vane slots formed along a circumferential direction with back pressure chambers formed at one end of each of the vane slots. A plurality of vanes are slidably supported in the vane slots protruding toward an inner circumferential surface of the cylinder. A compression space formed by the vanes between the roller and the cylinder includes an inlet port and an outlet port formed at both sides of a contact point between the roller and the cylinder. A vane positioned between the inlet port and the outlet port is configured such that a front gap between a front surface of the vane and the inner circumferential surface of the cylinder is smaller than a rear gap between a rear surface of the vane and an inner surface of the back pressure chamber.

18 Claims, 10 Drawing Sheets

(51) Int. Cl.
*F04C 29/00* (2006.01)
*F01C 21/08* (2006.01)

(52) U.S. Cl.
CPC ..... *F01C 21/0845* (2013.01); *F04C 2210/26* (2013.01); *F04C 2230/602* (2013.01); *F04C 2240/50* (2013.01)

(56) References Cited

U.S. PATENT DOCUMENTS

| | | | | |
|---|---|---|---|---|
| 2,899,940 | A | 8/1959 | Gibbs et al. | |
| 2,949,081 | A | 8/1960 | Deschamps | |
| 4,810,177 | A | 3/1989 | Shibuya | |
| 8,905,734 | B2 * | 12/2014 | Shin | F01C 21/10 418/58 |
| 2004/0136841 | A1 | 7/2004 | Takahashi | |
| 2005/0053506 | A1 * | 3/2005 | Cho | F04C 23/001 418/23 |
| 2009/0162234 | A1 * | 6/2009 | Shimaguchi | F04C 18/3446 418/266 |
| 2013/0022487 | A1 | 1/2013 | Helle | |
| 2014/0369878 | A1 | 12/2014 | Shimaguchi | |
| 2015/0064042 | A1 | 3/2015 | Shimaguchi | |
| 2015/0132168 | A1 * | 5/2015 | Tsuda | F04C 18/3441 418/15 |
| 2015/0147216 | A1 | 5/2015 | Shimaguchi | |
| 2016/0333877 | A1 | 11/2016 | Tsuda | |
| 2017/0350391 | A1 | 12/2017 | Tsuda | |

FOREIGN PATENT DOCUMENTS

| | | | | |
|---|---|---|---|---|
| CN | 104948458 | | 9/2015 | |
| CN | 106795883 | | 5/2017 | |
| CN | 105402125 | | 6/2018 | |
| JP | 61034374 | A * | 2/1986 | |
| JP | 2013213438 | | 10/2013 | |
| KR | 10-2017-0092044 | | 8/2017 | |
| KR | 10-2018-0095391 | | 8/2018 | |
| WO | WO 2018/151428 | A1 | 8/2018 | |
| WO | WO-2018151428 | A1 * | 8/2018 | F04B 39/0246 |

* cited by examiner

VANE ROTARY COMPRESSOR

CROSS-REFERENCE TO RELATED APPLICATION

This Application is a continuation of U.S. patent application Ser. No. 16/541,260, filed on Aug. 15, 2019, which claims priority under 35 U.S.C. § 119(a) to Korean Application No. 10-2018-0142076, filed on Nov. 16, 2018, the contents of which are incorporated by reference herein in their entireties.

BACKGROUND OF THE DISCLOSURE

1. Field of the Disclosure

The present disclosure relates to a compressor, more particularly, a vane rotary compressor in which a vane protruding from a rotating roller comes in contact with an inner circumferential surface of a cylinder to form a compression chamber.

2. Background Art

A rotary compressor can be divided into two types, namely, a type in which a vane is slidably inserted into a cylinder to come in contact with a roller, and another type in which a vane is slidably inserted into a roller to come in contact with a cylinder. Normally, the former is referred to as a 'rotary compressor' and the latter is referred to as a 'vane rotary compressor'.

As for a rotary compressor, a vane inserted in a cylinder is pulled out toward a roller by elastic force or back pressure to come into contact with an outer circumferential surface of the roller. On the other hand, for a vane rotary compressor, a vane inserted in a roller rotates together with the roller, and is pulled out by centrifugal force and back pressure to come into contact with an inner circumferential surface of a cylinder.

A rotary compressor independently forms compression chambers as many as the number of vanes per revolution of a roller, and each compression chamber simultaneously performs suction, compression, and discharge strokes. On the other hand, a vane rotary compressor continuously forms compression chambers as many as the number of vanes per revolution of a roller, and each compression chamber sequentially performs suction, compression, and discharge strokes. Accordingly, the vane rotary compressor has a higher compression ratio than the rotary compressor. Therefore, the vane rotary compressor is more suitable for high pressure refrigerants such as R32, R410a, and CO2, which have low ozone depletion potential (ODP) and global warming index (GWP).

Such a vane rotary compressor is disclosed in Patent Document [Japanese Patent Application Laid-Open No. JP2013-213438A, (Published on Oct. 17, 2013)]. The related art vane rotary compressor discloses a low-pressure type in which a suction refrigerant is filled in an inner space of a motor room but has a structure in which a plurality of vanes is slidably inserted into a rotating roller, which is features of a vane rotary compressor.

As disclosed in the patent document, back pressure chambers R are formed at rear end portions of vanes, respectively, communicating with back pressure pockets 21, 31 and 22, 32. The back pressure pockets are divided into a first pocket 21, 31 forming first intermediate pressure and a second pocket 22, 32 forming second intermediate pressure higher than the first intermediate pressure and close to discharge pressure. Oil is depressurized between a rotation shaft and a bearing and introduced into the first pocket through a gap between the rotation shaft and the bearing. On the other hand, oil is introduced into the second pocket, with almost no pressure loss, through a flow path 34*a* penetrating through the bearing due to the gap between the rotation shaft and the bearing blocked. Therefore, the first pocket communicates with a back pressure chamber located at an upstream side, and the second pocket communicates with a back pressure chamber located at a downstream side based on a direction toward a discharge part from a suction part.

However, in the related art vane rotary compressor as described above, a rear surface of the vane receives pressure of the first intermediate pressure or the second intermediate pressure. On the other hand, a front surface of the vane receives different pressure at a front side and a rear side of the vane with respect to a movement direction of the vane. In particular, the front surface receives compression pressure and suction pressure consequently (continuously) based on a contact point where a cylinder and a roller are in close proximity with each other. Since the compression pressure is higher than the back pressure and suction pressure is lower than back pressure, vane vibration is caused by a difference of pressure applied to the front surface of the vane as the vane passes the contact point between the cylinder and the roller. At this time, the front surface of the vane and an inner circumferential surface of the cylinder are separated from each other while the vane is moving backwards. As a result, a refrigerant in a discharge chamber flows into a suction chamber, causing suction loss and compression loss.

In addition, the inner circumferential surface of the cylinder gets hit by the vane while the vane vibration occurs, which causes abrasion on the inner circumferential surface of the cylinder or the front surface of the vane, leading to a further increase in the suction loss and compression loss.

Also, the vane vibration generates more noise from the compressor.

If the back pressure is increased in order to prevent the vane from being pushed backwards, contact force between the vane and the cylinder increases over an entire section of a compression stroke, thereby increasing friction loss.

Further, in the related art vane rotary compressor, pressure of oil supplied to the rear surface of the vane is not even, which causes pressure pulsation. As a result, inconsistent back pressure is formed on the rear surface of the vane, thereby further increasing the vane vibration and simultaneously extending a vibration distance of the vane.

This may be particularly problematic when a high-pressure refrigerant such as R32, R410a, or CO2 is used. In more detail, when the high-pressure refrigerant is used, the same level of cooling capability may be obtained as that when using relatively a low-pressure refrigerant such as R134a, even though the volume of each compression chamber is reduced by increasing the number of vanes. However, if the number of vanes increases, a frictional area between the vanes and the cylinder are increased accordingly. As a result, a bearing surface on the rotation shaft is reduced, which makes behavior of the rotation shaft more unstable, leading to a further increase in mechanical friction loss. This may be even worse under a low-temperature heating condition, a high pressure ratio condition ($Pd/Ps \geq 6$), and a high-speed operating condition (above 80 Hz).

SUMMARY OF THE DISCLOSURE

One aspect of the present disclosure is to provide a vane rotary compressor capable of maintaining back pressure while preventing a vane from being pushed backwards.

Another aspect of the present disclosure is to provide a vane rotary compressor capable of reducing leakage of compressed refrigerant, lowering noise and vibration, and suppressing abrasion by minimizing a distance between a vane and a cylinder.

Still another aspect of the present disclosure is to provide a vane rotary compressor capable of minimizing a vibration distance of a vane by optimizing the length of a vane.

Still another aspect of the present disclosure is to provide a vane rotary compressor capable of minimizing a vibration distance of a vane by forming a surface on a roller and the vane for limiting the vibration distance.

Still another aspect of the present disclosure is to provide a vane rotary compressor capable of minimizing a vibration distance by providing a member on a roller for supporting the vane.

Still another aspect of the present disclosure is to provide a vane rotary compressor capable of suppressing vane vibration and simultaneously minimizing a vibration distance by forming uniform discharge pressure on a rear surface of a vane.

Still another aspect of the present disclosure is to provide a vane rotary compressor capable of suppressing vane vibration and simultaneously minimizing a vibration distance when high-pressure refrigerants such as R32, R410a, and CO2 are used.

In order to achieve the aspects and other advantages of the present disclosure, there is provided a vane rotary compressor, including a cylinder, a main bearing and a sub bearing coupled to the cylinder to form a compression space together with the cylinder and having a back pressure pocket formed on a surface facing the cylinder, a rotation shaft radially supported by the main bearing and the sub bearing, a roller having an outer circumferential surface of one side thereof positioned in close proximity with an inner circumferential surface of the cylinder to form a contact point, the roller provided with a plurality of vane slots formed along a circumferential direction and having one end opened toward the outer circumferential surface, and back pressure chambers each formed at an opposite end of each vane slot so as to communicate with the back pressure pocket, and a plurality of vanes slidably inserted into the vane slots of the roller, and protruding in a direction toward an inner circumferential surface of the cylinder by back pressure and centrifugal force of the back pressure chamber so as to divide the compression space into a plurality of compression chambers, wherein the compression space is provided with an inlet port and an outlet port formed at both sides of the contact point, wherein a vane, among the plurality of vanes, located between the inlet port and the outlet port is formed in a manner that a front gap between a front surface of the vane and an inner circumferential surface of the cylinder is smaller than a rear gap between a rear surface of the vane and an inner surface of the back pressure chamber that the rear surface of the vane face, but greater than an entire lateral gap between the inner surface of the back pressure chamber and a side surface of the vane, in a state where the rear surface of the vane facing the back pressure chamber is in contact with the back pressure chamber.

Here, the front gap 1 may be formed to be smaller than or equal to 50 μm.

The front gap may be formed to be greater than or equal to a preset minimum assembly gap.

The minimum assembly gap may be formed to be 10 μm.

The back pressure chamber may have a maximum width greater than or equal to a width of the vane slot.

The back pressure chamber may have an inner circumferential surface in a curved shape and the vane has the rear surface with a right-angled corner.

The back pressure chamber may have an inner circumferential surface formed in a curved shape and the vane has a rear corner chamfered to have a tapered shape.

Here, the back pressure chamber may be provided with an elastic member to support a rear surface of the vane slot.

The elastic member may be implemented as a leaf spring fixedly inserted into the back pressure chamber or the vane slot.

Here, a vane stop surface may be formed in a stepped manner between the vane slot and the back pressure chamber so as to restrict backward movement of the vane.

At least one of the main bearing and the sub bearing may be provided with a back pressure pocket communicating with the back pressure chamber. The back pressure pocket may be divided into a plurality of pockets having different inner pressure along a circumferential direction, and the plurality of pockets may be provided with bearing protrusion portions formed on an inner circumferential side facing an outer circumferential surface of the rotation shaft and forming radial bearing surfaces with respect to the outer circumferential surface of the rotation shaft.

In addition, the plurality of pockets may be provided with a first pocket having first pressure and a second pocket having a pressure higher than the first pressure. The bearing protrusion portion of the second pocket may be provided with a communication flow path to communicate an inner circumferential surface of the bearing protrusion portion facing the outer circumferential surface of the rotation shaft and an outer circumferential surface as an opposite side surface of the inner circumferential surface of the bearing protrusion portion.

The communication flow path may be formed in a manner that at least part thereof overlaps an oil groove provided on a radial bearing surface of the main bearing or the sub bearing, and the communication flow path may be formed as a communication groove or a communication hole.

The rotation shaft may be provided with an oil flow path formed in a central portion thereof along an axial direction. The oil flow path may be provided with an oil passage hole formed through an inner circumferential surface thereof toward the outer circumferential surface of the rotation shaft. The oil passage hole may be formed within a range of the radial bearing surface.

In a vane rotary compressor according to the present disclosure, a length of a vane can be limited so as to minimize a vibration distance of the vane, thereby minimizing a distance that the vane is pushed backwards while the vane is vibrating. This may result in minimizing a distance between the vane and the cylinder when the vane is vibrating.

Further, a compressed refrigerant can be prevented from leaking during operation of the compressor. In addition, vibration noise, and abrasion of the vane and the cylinder can be reduced by reducing an amount of collision between the vane and the cylinder.

A vibration distance of the vane can be minimized while maintaining back pressure by optimizing the length of the vane, thereby reducing refrigerant leakage, vibration noise, and abrasion.

Further, the vibration distance of the vane can be minimized while maintaining the back pressure by forming a surface that limits the vibration distance of the vane between the roller and the vane. This may result in reducing refrigerant leakage, vibration noise and abrasion.

The vibration distance of the vane can be minimized while maintaining the back pressure by providing a member on the roller for supporting the vane, thereby reducing refrigerant leakage, vibration noise, and abrasion.

In the vane rotary compressor according to the present disclosure, the back pressure pocket communicating with the back pressure chamber provided at the rear side of the vane is formed in a semi-open shape so that uniform back pressure can be formed at the rear surface of the vane. As a result, the vibration distance can be minimized while suppressing the vane vibration.

In addition, the vane rotary compressor according to the present disclosure optimizes the vibration distance of the vane even when using a high-pressure refrigerant such as R32, R410a, or CO2, which may result in suppressing the vane vibration and minimizing the vibration distance. Therefore, leakage between compression chambers can be prevented and behavior of the vane can be stabilized, thereby enhancing reliability of the vane rotary compressor using the high-pressure refrigerant.

Furthermore, in the vane rotary compressor according to the present disclosure, the aforementioned effects can be achieved even under a low-temperature heating condition, a high-pressure ratio condition, and a high-speed operation condition.

BRIEF DESCRIPTION OF THE DRAWING

FIG. 2 is a sectional view taken along line "IV-IV" of FIG. 1, and FIG. 3 is a sectional view taken along line "V-V" of FIG. 2.

DETAILED DESCRIPTION OF THE PREFERRED EMBODIMENT

Description will now be given in detail of a vane rotary compressor according to exemplary embodiments disclosed herein, with reference to the accompanying drawings.

Figure 1:
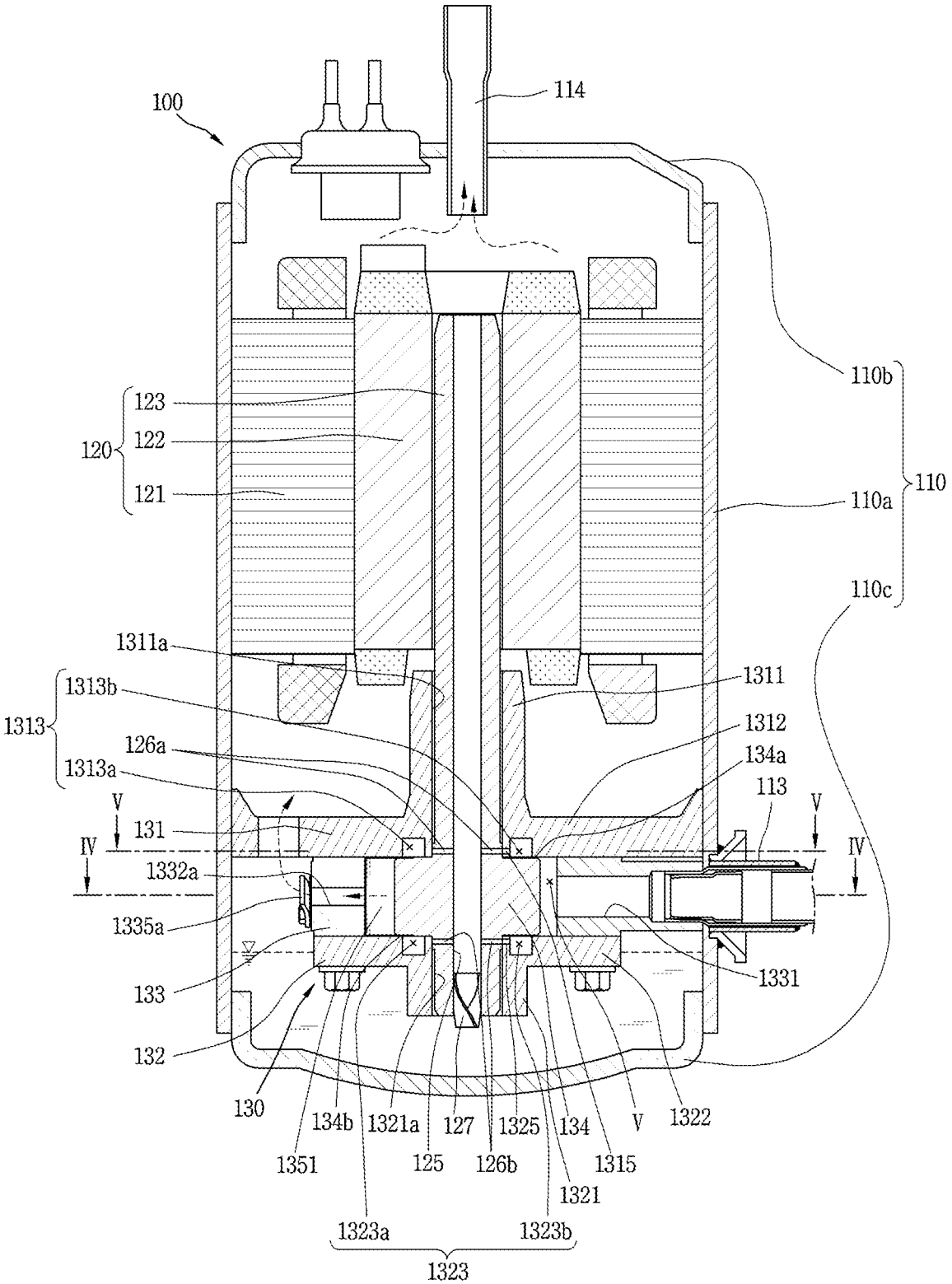
FIG. 1 is a longitudinal sectional view of an exemplary vane rotary compressor according to the present disclosure.
Figure 2:
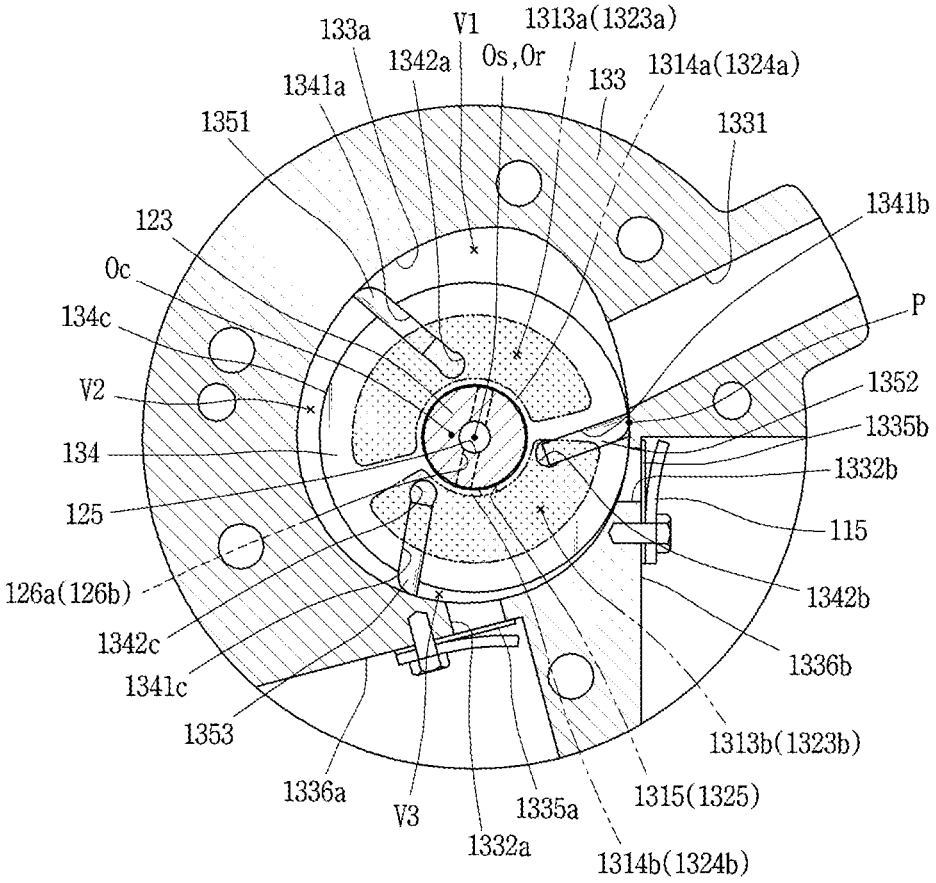
FIGS. 2 and 3 are horizontal sectional views of a compression unit applied in FIG. 1, namely.
Figure 3:
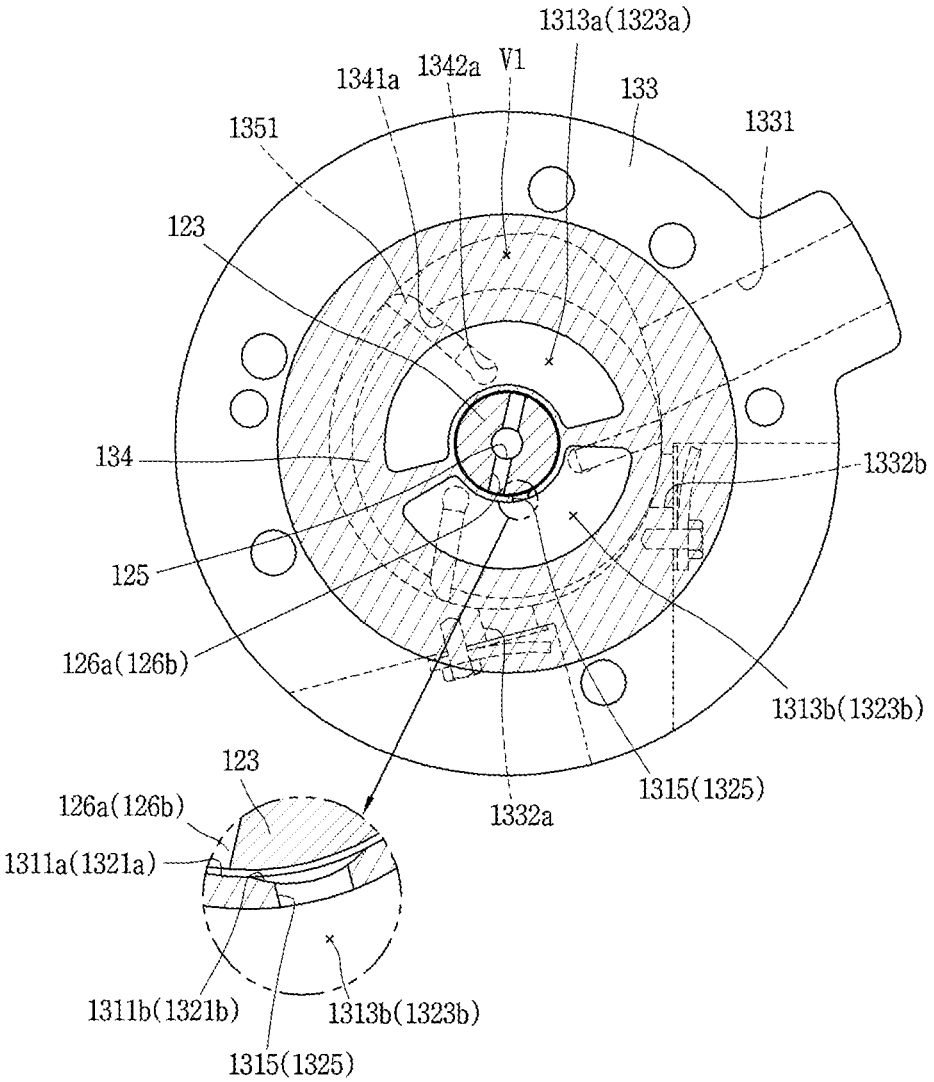

FIG. 1 is a longitudinal sectional view of an exemplary vane rotary compressor according to the present disclosure, and FIGS. 2 and 3 are horizontal sectional views of a compression unit applied in FIG. 1. FIG. 2 is a sectional view taken along line "IV-IV" of FIG. 1, and FIG. 3 is a sectional view taken along line "V-V" of FIG. 2.

Referring to FIG. 1, a vane rotary compressor according to the present disclosure includes a driving motor 120 installed in a casing 110 and a compression unit 130 provided at one side of the driving motor 120 and mechanically connected to each other by a rotation shaft 123.

The casing 110 may be classified as a vertical type or a horizontal type according to a compressor installation method. As for the vertical-type casing, the driving motor and the compression unit are disposed at both upper and lower sides along an axial direction. And as for the horizontal-type casing, the driving motor and the compression unit are disposed at both left and right sides.

The driving motor 120 provides power for compressing a refrigerant. The driving motor 120 includes a stator 121, a rotor 122, and a rotation shaft 123.

The stator 121 is fixedly inserted into the casing 110. The stator 121 may be mounted on an inner circumferential surface of the cylindrical casing 110 in a shrink-fitting manner or so. For example, the stator 121 may be fixedly mounted on an inner circumferential surface of an intermediate shell 110*a*.

The rotor 122 is disposed with being spaced apart from the stator 121 and located at an inner side of the stator 121. The rotation shaft 123 is press-fitted into a central part of the rotor 122. Accordingly, the rotation shaft 123 rotates concentrically together with the rotor 122.

An oil flow path 125 is formed in a central part of the rotation shaft 123 in an axial direction, and oil passage holes 126*a* and 126*b* are formed through a middle part of the oil flow path 125 toward an outer circumferential surface of the rotation shaft 123. The oil passage holes 126*a* and 126*b* include a first oil passage hole 126*a* belonging to a range of a first shaft receiving portion 1311 to be described later and a second oil passage hole 126*b* belonging to a range of a second shaft receiving portion 1321. Each of the first oil passage hole 126*a* and the second oil passage hole 126*b* may be provided by one or in plurality. In this embodiment, the first and second oil passage holes are provided in plurality, respectively.

An oil feeder 127 is installed at a middle or lower end of the oil flow path 125. Accordingly, when the rotation shaft 123 rotates, oil filled in a lower part of the casing is pumped by the oil feeder 127 and is sucked along the oil flow path 125, so as to be introduced into a sub bearing surface 1321*a* with the second shaft receiving portion through the second oil passage hole 126*b* and into a main bearing surface 1311*a* with the second shaft receiving portion through the first oil passage hole 126*a*.

The first oil passage hole 126*a* and the second oil passage hole 126*b* may be formed so as to overlap a first oil groove 1311*b* and a second oil groove 1321*b*, respectively, which are to be explained later. In this way, oil supplied to the bearing surfaces 1311*a* and 1321*a* of a main bearing 131 and a sub bearing 132 through the first oil passage hole 126*a* and the second oil passage hole 126*b* can be quickly introduced into a main-side second pocket 1313*b* and a sub-side second pocket 1323*b* to be explained later.

The compression unit 130 includes a cylinder 133 in which a compression space V is formed by the main bearing 131 and the sub bearing 132 installed on both sides of cylinder 133 in an axial direction.

Referring to FIGS. 1 and 2, the main bearing 131 and the sub bearing 132 are fixedly installed on the casing 110 and are spaced apart from each other along the rotation shaft 123. The main bearing 131 and the sub bearing 132 radially support the rotation shaft 123 and axially support the cylinder 133 and a roller 134 at the same time. As a result, the main bearing 131 and the sub bearing 132 may be provided with a shaft receiving portion 1311, 1321 radially supporting the rotation shaft 123, and a flange portion 1312, 1322 radially extending from the shaft receiving portion 1311, 1321. For convenience of explanation, the shaft receiving portion and the flange portion of the main bearing 131 are defined as the first bearing portion 1311 and the first flange portion 1312, respectively, and the shaft receiving portion and the flange portion of the sub bearing 132 are defined as the second bearing portion 1321 and the second flange portion 1322, receptively.

Referring to FIGS. 1 and 3, the first bearing portion 1311 and the second bearing portion 1321 are formed in a bushing shape, respectively, and the first flange portion and the second flange portion are formed in a disk shape, respectively. A first oil groove 1311*b* is formed on a radial bearing surface (hereinafter, abbreviated as "bearing surface" or "first bearing surface") 1311*a*, which is an inner circumferential surface of the first shaft receiving portion 1311, and a second oil groove 1321*b* is formed on a radial bearing surface (hereinafter, abbreviated as "bearing surface" or "second bearing surface") 1321*a*, which is an inner circumferential surface of the second shaft receiving portion 1321. The first oil groove 1311*b* is formed linearly or diagonally between upper and lower ends of the first shaft receiving portion 1311, and the second oil groove 1321*b* is formed linearly or diagonally between upper and lower ends of the second shaft receiving portion 1321.

A first communication flow path 1315 to be described later is formed in the first oil groove 1311*b*, and a second communication flow path 1325 to be described later is formed in the second oil groove 1321*b*. The first communication flow path 1315 and the second communication flow path 1325 are provided for guiding oil flowing into the respective bearing surfaces 1311*a* and 1321*a* to a main-side back pressure pocket 1313 and a sub-side back pressure pocket 1323. This will be explained later.

The first flange portion 1312 is provided with the main-side back pressure pocket 1313, and the second flange portion 1322 is provided with the sub-side back pressure pocket 1323. The main-side back pressure pocket 1313 is provided with a main-side first pocket 1313*a* and a main-side second pocket 1313*b*, and the sub-side back pressure pocket 1323 is provided with a sub-side first pocket 1323*a* and a sub-side second pocket 1323*b*.

The main-side first pocket 1313*a* and the main-side second pocket 1313*b* are formed with a predetermined spacing therebetween along a circumferential direction, and the sub-side first pocket 1323*a* and the sub-side second pocket 1323*b* are formed with a predetermined spacing therebetween along the circumferential direction.

The main-side first pocket 1313*a* forms pressure lower than pressure formed in the main-side second pocket 1313*b*, for example, forms intermediate pressure between suction pressure and discharge pressure. And the sub-side first pocket 1323*a* forms pressure lower than pressure formed in the sub-side second pocket 1323*b*, for instance, forms intermediate pressure nearly the same as the pressure of the main-side first pocket 1313*a*. The main-side first pocket 1313*a* forms intermediate pressure by being decompressed while oil is introduced into the main-side first pocket 1313*a* through a fine or narrow passage between a main-side first bearing protrusion portion 1314*a* and an upper surface 134*a* of the roller 134 to be described later, and the sub-side first pocket 1323*a* also forms intermediate pressure by being decompressed while oil is introduced into the sub-side first pocket 1323*a* through a fine passage between a sub-side first bearing protrusion portion 1314*b* and a lower surface 134*b* of the roller 134 to be described later. On the other hand, the main-side second pocket 1313*b* and the sub-side second pocket 1323*b* maintain discharge pressure or pressure almost equal to discharge pressure as oil, which is introduced into the main bearing surface 1311*a* and the sub bearing surface 1321*a* through the first oil passage hole 126*a* and the second oil passage hole 126*b*, flows into the main-side second pocket 1313*b* and the sub-side second pocket 1323*b* through the first communication flow path 1315 and the second communication flow path 1325 to be described later.

An inner circumferential surface, which constitutes a compression space V, of a cylinder 133 is formed in an elliptical shape. The inner circumferential surface of the cylinder 133 may be formed in a symmetric elliptical shape having a pair of major and minor axes. However, the inner circumferential surface of the cylinder 133 has an asymmetric elliptical shape having multiple pairs of major and minor axes in this embodiment of the present disclosure. This cylinder 133 formed in the asymmetric elliptical shape is generally referred to as a hybrid cylinder, and this embodiment describes a vane rotary compressor to which such a hybrid cylinder is applied. However, a back pressure pocket structure according to the present disclosure is equally applicable to a vane rotary compressor with a cylinder with a symmetric elliptical shape.

As illustrated in FIGS. 2 and 3, an outer circumferential surface of the hybrid cylinder (hereinafter, abbreviated simply as "cylinder") 133 according to this embodiment may be formed in a circular shape. However, a non-circular shape may also be applied if it is fixed to an inner circumferential surface of the casing 110. Of course, the main bearing 131 and the sub bearing 132 may be fixed to the inner circumferential surface of the casing 110, and the cylinder 133 may be coupled to the main bearing 131 or the sub bearing 132 fixed to the casing 110 with a bolt.

In addition, an empty space is formed in a central portion of the cylinder 133 so as to form a compression space V including an inner circumferential surface. This empty space is sealed by the main bearing 131 and the sub bearing 132 to form the compression space V. The roller 134 to be described later is rotatably coupled to the compression space V.

The inner circumferential surface 133*a* of the cylinder 133 is provided with an inlet port 1331 and outlet ports 1332*a* and 1332*b* on both sides of a circumferential direction with respect to a point where the inner circumferential surface 133*a* of the cylinder 133 and an outer circumferential surface 134*c* of the roller 134 are almost in contact with each other.

The inlet port 1331 is directly connected to a suction pipe 113 penetrating through the casing 110, and the outlet ports 1332*a* and 1332*b* communicates with an inner space of the casing 110, thereby being indirectly connected to a discharge pipe 114 coupled to the casing 110 in a penetrating manner. Accordingly, a refrigerant is sucked directly into the compression space V through the inlet port 1331 while a compressed refrigerant is discharged into the inner space of the casing 110 through the outlet ports 1332*a* and 1332*b*, and is then discharged to the discharge pipe 114. As a result, the inner space of the casing 110 is maintained in a high-pressure state forming discharge pressure.

In addition, the inlet port 1331 is not provided with an inlet valve, separately, however, the outlet ports 1332*a* and 1332*b* are provided with discharge valves 1335*a* and 1335*b*, respectively, for opening and closing the outlet ports 1332*a* and 1332*b*. The discharge valves 1335*a* and 1335*b* may be a lead-type valve having one end fixed and another end free. However, various types of a valve such as a piston valve, other than the lead-type valve, may be used for the discharge valves 1335*a* and 1335*b* as necessary.

When the lead-type valve is used for discharge valves 1335*a* and 1335*b*, valve grooves 1336*a* and 1336*b* are formed on an outer circumferential surface of the cylinder 133 so as to mount the discharge valves 1335*a* and 1335*b*. Accordingly, the length of the outlet ports 1332*a* and 1332*b* is reduced to minimum, thereby decreasing in dead volume. The valve grooves 1336*a* and 1336*b* may be formed in a triangular shape so as to secure a flat valve seat surface as illustrated in FIGS. 2 and 3.

The plurality of outlet ports 1332*a* and 1332*b* are formed along a compression passage (a compression proceeding direction). For convenience of explanation, an outlet port located at an upstream side of the compression passage is referred to as a sub outlet port (or a first outlet port) 1332*a*, and an outlet port located at a downstream side of the compression passage is referred to as a main outlet port (or a second outlet port) 1332*b*.

However, the sub outlet port is not necessarily required and may be selectively formed as necessary. For example, the sub outlet port may not be formed on the inner circumferential surface 133*a* of the cylinder 133 if overcompression of a refrigerant is appropriately reduced by forming a long compression period. However, the sub outlet port 1332*a* may be formed at a front part of the main outlet port 1332*b*, that is, at an upstream part of the main outlet port 1332*b* based on the compression proceeding direction in order to minimize an amount of refrigerant overcompressed.

Referring to FIGS. 2 and 3, the roller 134 described above is rotatably provided in the compression space V of the cylinder 133. The outer circumferential surface 134*c* of the roller 134 is formed in a circular shape, and the rotation shaft 123 is integrally coupled to a central part of the roller 134. In this way, the roller 134 has a center Or coinciding with an axial center Os of the rotation shaft 123, and concentrically rotates together with the rotation shaft 123 centering around the center Or of the roller 134.

The center Or of the roller 134 is eccentric with respect to a center Oc of the cylinder 133, that is, a center of the inner space of the cylinder 133 (hereinafter, referred to as "the center of the cylinder"), and one side of the outer circumferential surface 134*c* of the roller 134 is almost in contact with the inner circumferential surface 133*a* of the cylinder 133. Here, when an arbitrary point of the cylinder 133 where one side of the outer circumferential surface of the roller 134 is closest to the inner circumferential surface of the cylinder 133 and the roller 134 comes into close proximity with the cylinder 133 is referred to as a contact point P, a central line passing through the contact point P and the center of the cylinder 133 may be a position for a minor axis of the elliptical curve forming the inner circumferential surface 133*a* of the cylinder 133.

The roller 134 has a plurality of vane slots 1341*a*, 1341*b* and 1341*c* formed in an outer circumferential surface thereof at appropriate places along a circumferential direction. And vanes 1351, 1352 and 1353 are slidably inserted into the vane slots 1341*a*, 1341*b* and 1341*c*, respectively. The vane slots 1341*a*, 1341*b*, and 1341*c* may be formed in a radial direction with respect to the center of the roller 134. In this case, however, it is difficult to sufficiently secure a length of the vane. Therefore, the vane slots 1341*a*, 1341*b*, and 1341*c* may preferably be formed to be inclined at a predetermined inclination angle with respect to the radial direction in that the length of the vane can be sufficiently secured.

Here, a direction to which the vanes 1351, 1352 and 1353 are tilted is an opposite direction to a rotation direction of the roller 134, that is, the front surface of the vanes 1351, 1352, and 1353 in contact with the inner circumferential surface 133*a* of the cylinder 133 is tilted in the rotation direction of the roller 134. This is preferable in that a compression start angle can be moved forward in the rotation direction of the roller 134 so that compression can start quickly.

In addition, back pressure chambers 1342*a*, 1342*b* and 1342*c* are formed at inner ends of the vanes 1351, 1352 and 1353, respectively, to introduce oil (or refrigerant) into a rear side of the vane slots 1341*a*, 1341*b*, and 1341*c* so as to push each vane toward the inner circumferential surface of the cylinder 133. For convenience of explanation, a direction toward the cylinder with respect to a movement direction of the vane is defined as a forward direction, and an opposite direction is defined as a backward direction.

The back pressure chambers 1342*a*, 1342*b* and 1342*c* are hermetically sealed by the main bearing 131 and the sub bearing 132. The back pressure chambers 1342*a*, 1342*b* and 1342*c* may independently communicate with the back pressure pockets 1313 and 1323, or the plurality of back pressure chambers 1342*a*, 1342*b* and 1342*c* may be formed to communicate together through the back pressure pockets 1313 and 1323.

The back pressure pockets 1313 and 1323 may be formed in the main bearing 131 and the sub bearing 132, respectively, as shown in FIG. 1. In some cases, however, they may be formed in only one bearing of the main bearing 131 and the sub bearing 132. In this embodiment of the present disclosure, the back pressure pockets 1313 and 1323 are formed in both the main bearing 131 and the sub bearing 132. For convenience of explanation, the back pressure pocket formed in the main bearing is defined as a main-side back pressure pocket 1313, and the back pressure pocket formed in the sub bearing 132 is defined as a sub-side back pressure pocket 1323.

As described above, the main-side back pressure pocket 1313 is provided with the main-side first pocket 1313*a* and the main-side second pocket 1313*b*, and the sub-side back pressure pocket 1323 is provided with the sub-side first pocket 1323*a* and the sub-side second pocket 1323*b*. Also, the second pockets of both the main side and the sub side form higher pressure compared to the first pockets. Accordingly, the main-side first pocket 1313*a* and the sub-side first pocket 1323*a* communicate with a back pressure chamber of a vane slot in which a vane located relatively at an upstream side (from the discharge stroke to the suction stroke) of the vanes is located, and the main-side second pocket 1313*b* and the sub-side second pocket 1323*b* communicate with a back pressure chamber of a vane slot in which a vane located relatively at a downstream side (from the suction stroke to the discharge stroke) of the vanes is located.

If the vanes 1351, 1352 and 1353 are defined sequentially as a first vane 1351, a second vane 1352, and a third vane 1353 starting from the contact point P in the compression proceeding direction, an interval corresponding to the circumferential angle is formed between the first vane 1351 and the second vane 1352, between the second vane 1352 and the third vane 1353, and between the third vane 1353 and the first vane 1351.

Accordingly, when a compression chamber formed between the first vane 1351 and the second vane 1352 is a first compression chamber V1, a compression chamber formed between the second vane 1352 and the third vane 1353 is a second compression chamber V2, and a compression chamber formed between the third vane 1353 and the first vane 1351 is a third compression chamber V3, all of the compression chambers V1, V2, and V3 have the same volume at the same crank angle.

The vanes 1351, 1352, and 1353 are formed in a substantially rectangular shape. Here, of both end surfaces of the vane in a lengthwise direction of the vane, a surface in contact with the inner circumferential surface 133*a* of the cylinder 133 is defined as a front surface of the vane, and a surface facing the back pressure chamber 1342*a*, 1342*b*, 1342*c* is defined as a rear surface of the vane.

The front surface of each of the vanes 1351, 1352 and 1353 is curved so as to be in line contact with the inner circumferential surface 133*a* of the cylinder 133, and the rear surface of the vane 1351, 1352 and 1353 is formed flat to be inserted into the back pressure chamber 1342*a*, 1342*b*, 1342*c* and evenly receive back pressure.

In FIG. 1, reference numerals 110*b* and 110*c* denote an upper shell and a lower shell, respectively.

In the vane rotary compressor having the hybrid cylinder, when power is applied to the driving motor 120 so that the rotor 122 of the driving motor 120 and the rotation shaft 123 coupled to the rotor 122 rotate together, the roller 134 rotates together with the rotation shaft 123.

Then, the vanes 1351, 1352 and 1353 are pulled out from the respective vane slots 1341*a*, 1341*b*, and 1341*c* by a centrifugal force generated due to the rotation of the roller 134 and back pressure of the back pressure chambers 1342*a*, 1342*b*, 1342*c* provided at the rear side of the vanes 1351, 1352, and 1353. Accordingly, the front surface of each of the vanes 1351, 1352, and 1353 is brought into contact with the inner circumferential surface 133*a* of the cylinder 133.

Then, the compression space V of the cylinder 133 is divided by the plurality of vanes 1351, 1352, and 1353 into a plurality of compression chambers (including a suction chamber or a discharge chamber) V1, V2, and V3 as many as the number of vanes 1351, 1352 and 1353. The volume of each compression chamber V1, V2 and V3 changes according to a shape of the inner circumferential surface 133*a* of the cylinder 133 and eccentricity of the roller 134 while moving in response to the rotation of the roller 134. A refrigerant filled in each of the compression chambers V1, V2, and V3 then flows along the roller 134 and the vanes 1351, 1352, and 1353 so as to be sucked, compressed and discharged.

This will be described in more detail as follows. FIG. 4A, FIG. 4B, FIG. 4C, and FIG. 4D are sectional views illustrating processes of sucking, compressing, and discharging a refrigerant in a cylinder according to the embodiment of the present disclosure. In FIG. 4A-FIG. 4D, the main bearing is projected, and the sub bearing not shown is the same as the main bearing.

Figure 4A:
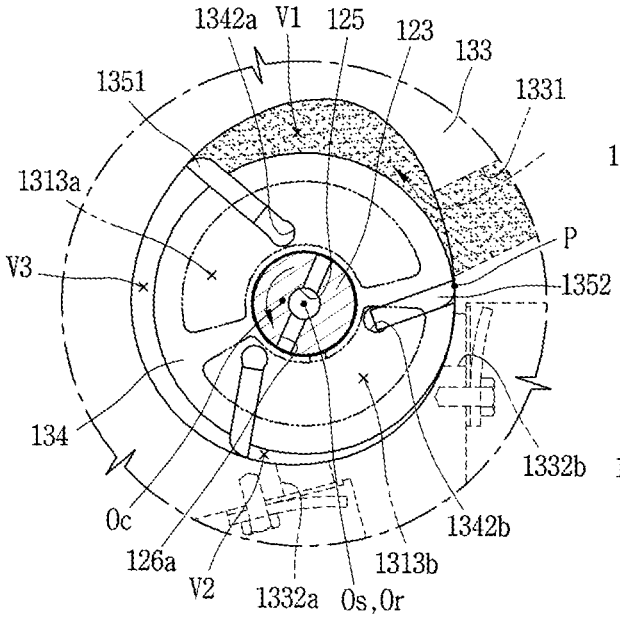
FIG. 4A-FIG. 4D are sectional views illustrating processes of sucking, compressing and discharging a refrigerant in a cylinder according to an embodiment of the present disclosure.

As illustrated in FIG. 4A, the volume of the first compression chamber V1 continuously increases until before the first vane 1351 passes through the inlet port 1331 and the second vane 1352 reaches a suction completion time, so that a refrigerant is continuously introduced into the first compression chamber V1 from the inlet port 1331.

At this time, the first back pressure chamber 1342*a* provided at the rear side of the first vane 1351 is exposed to the first pocket 1313*a* of the main-side back pressure pocket 1313, and the second back pressure chamber 1342*b* provided at the rear side of the second vane 1352 is exposed to the second pocket 1313*b* of the main-side back pressure pocket 1313. Accordingly, the first back pressure chamber 1342*a* forms intermediate pressure and the second back pressure chamber 1342*b* forms discharge pressure or pressure almost equal to discharge pressure (hereinafter, referred to as "discharge pressure"). The first vane 1351 is pressurized by the intermediate pressure and the second vane 1352 is pressurized by the discharge pressure, respectively, to be brought into close contact with the inner circumferential surface of the cylinder 133.

Figure 4B:
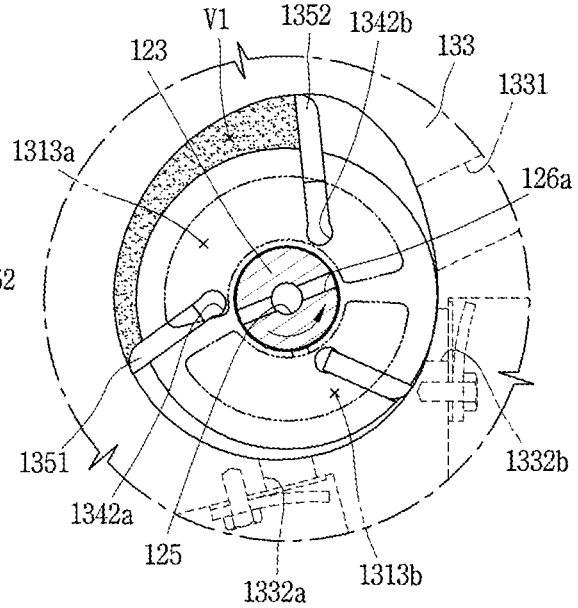

As illustrated in FIG. 4B, when the second vane 1352 performs a compression stroke after passing the suction completion time (or the compression start angle), the first compression chamber V1 is in a sealed state and moves in a direction toward the outlet port together with the roller 134. In this process, the volume of the first compression chamber V1 is continuously decreased and a refrigerant in the first compression chamber V1 is gradually compressed.

At this time, when refrigerant pressure in the first compression chamber V1 rises, the first vane 1351 may be pushed toward the first back pressure chamber 1342*a*. As a result, the first compression chamber V1 communicates with the preceding third chamber V3, which may cause refrigerant leakage. Therefore, higher back pressure needs to be formed in the first back pressure chamber 1342*a* in order to prevent the refrigerant leakage.

Referring to the drawings, the back pressure chamber 1342*a* of the first vane 1351 is about to enter the main-side second pocket 1313*b* after passing the main-side first pocket 1313*a*. Accordingly, back pressure formed in the first back pressure chamber 1342*a* of the first vane 1351 immediately rises to discharge pressure from intermediate pressure. As the back pressure of the first back pressure chamber 1342*a* increases, it is possible to suppress the first vane 1351 from being pushed backwards.

Figure 4C:
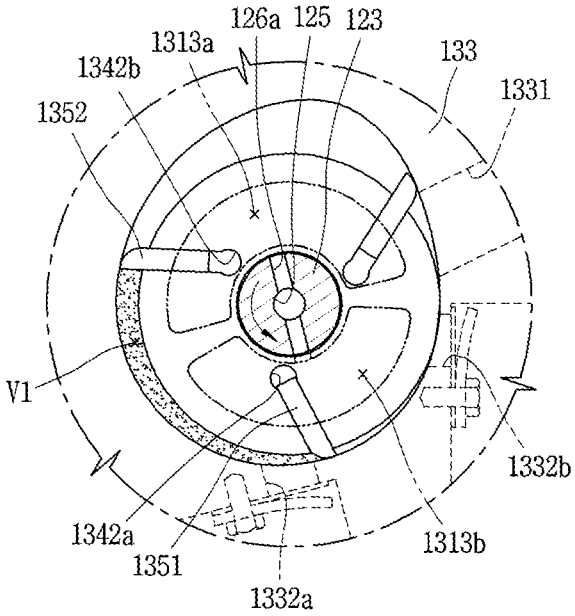

As illustrated in FIG. 4C, when the first vane 1351 passes through the first outlet port 1332*a* and the second vane 1352 has not reached the first outlet port 1332*a*, the first compression chamber V1 communicates with the first outlet port 1332*a* and the first outlet port 1332*a* is opened by pressure of the first compression chamber V1. Then, a part of a refrigerant in the first compression chamber V1 is discharged to the inner space of the casing 110 through the first outlet port 1332*a*, so that the pressure of the first compression chamber V1 is lowered to predetermined pressure. In the case of no first outlet port 1332*a*, a refrigerant in the first compression chamber V1 further moves toward the second outlet port 1332*b*, which is the main outlet port, without being discharged from the first compression chamber V1.

At this time, the volume of the first compression chamber V1 is further decreased so that the refrigerant in the first compression chamber V1 is further compressed. However, the first back pressure chamber 1342*a* in which the first vane 1351 is accommodated fully communicates with the main-side second pocket 1313*b* so as to form pressure almost equal to discharge pressure. Accordingly, the first vane 1351 is not pushed by back pressure of the first back pressure chamber 1342*a*, thereby suppressing leakage between compression chambers.

Figure 4D:
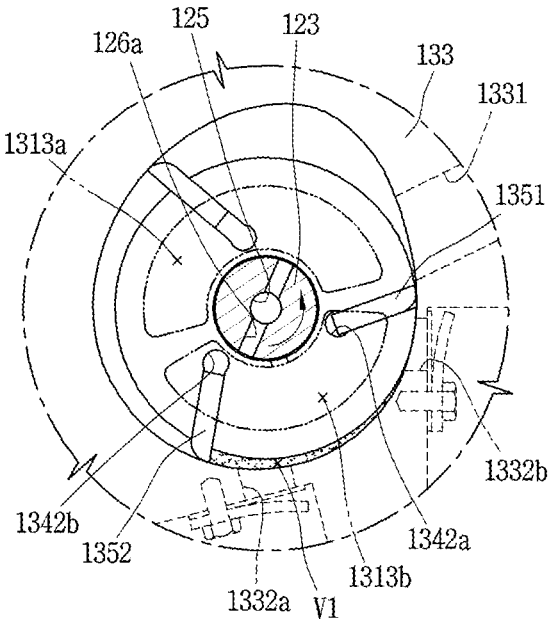

As illustrated in FIG. 4D, when the first vane 1351 passes through the second outlet port 1332*b* and the second vane 1352 reaches a discharge start angle, the second outlet port

1332*b* is opened by refrigerant pressure in the first compression chamber V1. Then, the refrigerant in the first compression chamber V1 is discharged to the inner space of the casing 110 through the second outlet port 1332*b*.

At this time, the back pressure chamber 1342*a* of the first vane 1351 is about to enter the main-side first pocket 1313*a* as an intermediate pressure region after passing the main-side second pocket 1313*b* as a discharge pressure region. Accordingly, back pressure formed in the back pressure chamber 1342*a* of the first vane 1351 is to be lowered to intermediate pressure from discharge pressure.

Meanwhile, the back pressure chamber 1342*b* of the second vane 1352 is located in the main-side second pocket 1313*b*, which is the discharge pressure region, and back pressure corresponding to discharge pressure is formed in the second back pressure chamber 1342*b*.

Figure 5:
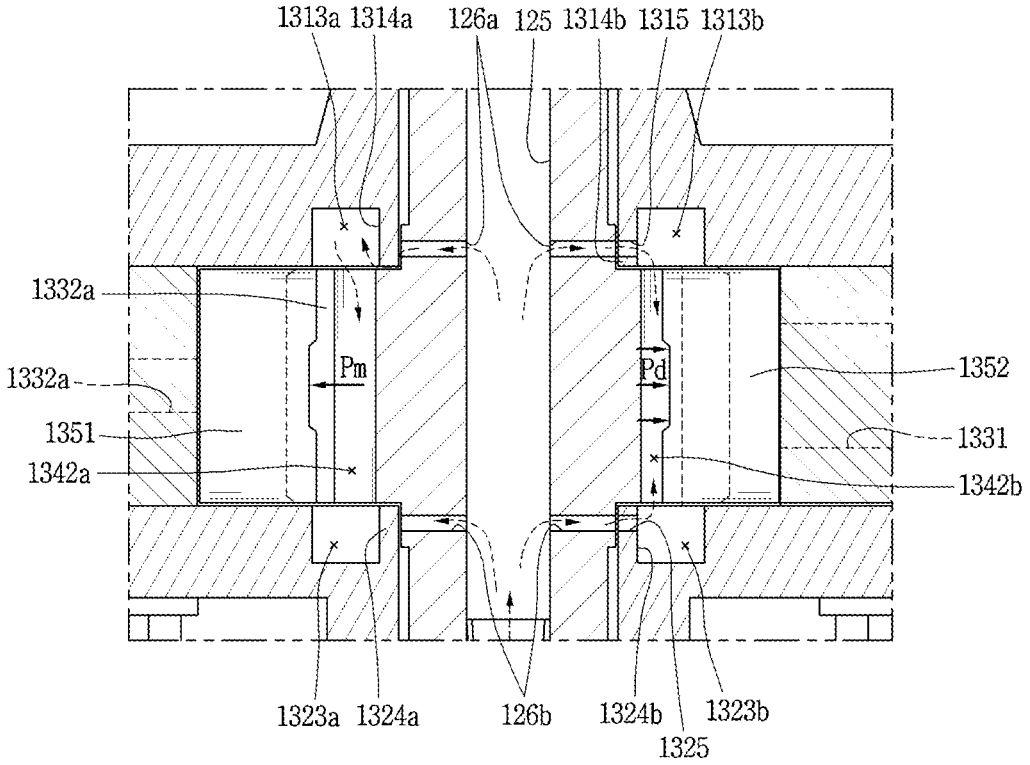
FIG. 5 is a longitudinal sectional view of a compression unit for explaining back pressure of each back pressure chamber in the vane rotary compressor according to the present disclosure.

FIG. 5 is a longitudinal sectional view of a compression unit for explaining back pressure of each back pressure chamber in the vane rotary compressor according to the present disclosure.

Referring to FIG. 5, intermediate pressure Pm between suction pressure and discharge pressure is formed at a rear end portion of the first vane 1351 positioned in the main-side first pocket 1313*a*, and discharge pressure Pd (actually pressure slightly lower than the discharge pressure) is formed at a rear end portion of the second vane 1352 positioned in the second pocket 1313*b*. In particular, as the main-side second pocket 1313*b* directly communicates with the oil flow path 125 through the first oil passage hole 126*a* and the first communication flow path 1315, pressure of the second back pressure chamber 1342*b* communicating with the main-side second pocket 1313*b* can be prevented from rising above the discharge pressure Pd. Accordingly, intermediate pressure Pm, which is much lower than the discharge pressure Pd, is formed in the main-side first pocket 1313*a*, thereby enhancing mechanical efficiency between the cylinder 133 and the vane 135. And as pressure equal to or slightly lower than the discharge pressure Pd is formed in the main-side second pocket 1313*b*, the vane is properly brought into close contact with the cylinder, thereby enhancing mechanical efficiency while suppressing leakage between compression chambers.

Meanwhile, the first pocket 1313*a* and the second pocket 1313*b* of the main-side back pressure pocket 1313 according to this embodiment communicate with the oil flow path 125 via the first oil passage hole 126*a*, and the first pocket 1323*a* and the second pocket 1323*b* of the sub-side back pressure pocket 1323 communicate with the oil flow path 125 via the second oil passage hole 126*b*.

Referring back to FIGS. 2 and 3, the main-side first pocket 1313*a* and the sub-side first pocket 1323*a* are closed by the main-side and sub-side first bearing protrusion portions 1314*a* and 1324*a* with respect to the bearing surfaces 1311*a* and 1321*a* that the main-side and sub-side first pockets 1313*a* and 1323*a* face, respectively. Accordingly, oil (refrigerant mixed oil) in the main-side and sub-side first pockets 1313*a* and 1323*a* flows into the bearing surfaces 1311*a* and 1321*a* through the respective oil passage holes 126*a* and 126*b*, and is decompressed while passing through a gap between the main-side and sub-side first bearing protrusion portions 1314*a* and 1324*a* and the opposite upper surface 134*a* or lower surface 134*b* of the roller 134, resulting in forming intermediate pressure.

On the other hand, the main-side and sub-side second pockets 1313*b* and 1323*b* communicate with the respective bearing surfaces 1311*a* and 1321*a*, which the second pockets face, by the main-side and sub-side second bearing protrusion portions 1314*b* and 1324*b*. Accordingly, oil (refrigerant mixed oil) in the main-side and sub-side second pockets 1313*b* and 1323*b* flows into the bearing surfaces 1311*a* and 1321*a* through the respective oil passage holes 126*a* and 126*b*, and is introduced into the respective second pockets 1313*b* and 1323*b* via the main-side and sub-side bearing protrusion portions 1314*b* and 1324*b*, thereby forming pressure equal to or slightly lower than the discharge pressure.

However, in the embodiment of the present disclosure, the main-side second pocket 1313*b* and the sub-side second pocket 1323*b* do not communicate in a fully opened state with the bearing surfaces 1311*a* and 1321*a*, which the pockets face, respectively. In other words, the main-side second bearing protrusion portion 1314*b* and the sub-side second bearing protrusion portion 1324*b* mostly block the main-side second pocket 1313*b* and the sub-side second pocket 1323*b*, however, partially block the respective second pockets 1313*b* and 1323*b* with the communication flow paths 1315 and 1325 interposed therebetween.

The flange portion 1312 of the main bearing 131 is provided with the main-side first pocket 1313*a* and second pocket 1313*b* formed along a circumferential direction with a predetermined distance, and the flange portion 1322 of the sub bearing 132 is provided with the main-side first pocket 1323*a* and second pocket 1323*b* formed along the circumferential direction with a predetermined distance.

Inner circumferential sides of the main-side first pocket 1313*a* and second pocket 1313*b* are blocked by the main-side first bearing protrusion portion 1314*a* and second bearing protrusion portion 1314*b*, respectively. And inner circumferential sides of the sub-side first pocket 1323*a* and second pocket 1323*b* are blocked by the sub-side first bearing protrusion portion 1324*a* and second bearing protrusion portion 1324*b*, respectively. Accordingly, the shaft receiving portion 1311 of the main bearing 131 forms a cylindrical bearing surface 1311*a* which is formed by a substantially continuous surface, and the shaft receiving portion 1321 of the sub bearing 132 forms a cylindrical bearing surface 1321*a* which is formed by a substantially continuous surface. In addition, the main-side first bearing protrusion portion 1314*a* and second bearing protrusion portion 1314*b*, and the sub-side first bearing protrusion portion 1324*a* and second bearing protrusion portion 1324*b* form a kind of elastic bearing surface.

The first oil groove 1311*b* is formed on the bearing surface 1311*a* of the main bearing 131 and the second oil groove 1321*b* is formed on the bearing surface 1321*a* of the sub bearing 132. The main-side second bearing protrusion portion 1314*b* is provided with the first communication flow path 1315 for communicating the main bearing surface 1311*a* with the main-side second pocket 1313*b*. And the sub-side second bearing protrusion portion 1324*b* is provided with the second communication flow path 1325 for communicating the sub-side bearing surface 1321*a* with the sub-side second pocket 1323*b*.

The first communication flow path 1315 is formed at a position where it overlaps the main-side second bearing protrusion portion 1315*b* and the first oil groove 1311*b* at the same time, and the second communication flow path 1325 is formed at a position where it overlaps the sub-side second bearing protrusion portion 1324*b* and the second oil groove 1321*b* at the same time.

Also, the first communication flow path 1315 and the second communication flow path 1325, as illustrated in FIG. 5, are formed as a communication hole passing through inner and outer circumferential surfaces of the main-side and sub-side second bearing protrusion portions 1315*b* and 1325*b*. Although not shown in the drawings, they may alternatively be formed as a communication groove recessed by a predetermined width and depth in a cross section of the main-side second bearing protrusion portion 1315*b* and the sub-side second bearing protrusion portion 1325*b*.

In the vane rotary compressor according to this embodiment of the present disclosure, as the continuous bearing surface is formed mostly at the main-side second pocket 1313*b* and the sub-side second pocket 1323*b* as well, behavior of the rotation shaft 123 can be stabilized so as to enhance mechanical efficiency of the compressor.

In addition, as the main-side second bearing protrusion portion 1314*b* and the sub-side second bearing protrusion portion 1324*b* substantially close the main-side second pocket 1313*b* and the sub-side second pocket 1323*b* except for the communication flow paths, the main-side second pocket 1313*b* and the sub-side second pocket 1323*b* maintain a constant volume. Accordingly, pressure pulsation of back pressure to support the vane in the main-side second pocket 1313*b* and the sub-side second pocket 1323*b* can be lowered to stabilize behavior of the vane while suppressing vibration. As a result, collision noise between the vane and the cylinder and leakage between compression chambers can be reduced, thereby improving compression efficiency.

It is also possible to prevent foreign substances from being introduced and accumulated between the bearing surfaces 1311*a* and 1321*a* and the rotation shaft 123 via the main-side second pocket 1313*b* and the sub-side second pocket 1323*b* even during long-time operation. This may result in preventing abrasion of the bearings 131 and 132 or the rotation shaft 123.

In addition, according to the embodiment of the present disclosure, when a high-pressure refrigerant such as R32, R410a, and CO2 is used, surface pressure against a bearing may be higher than that when a medium to low pressure refrigerant such as R134a is used. However, it is possible to increase a radial support force with respect to the rotation shaft 123 described above. Also, for a high-pressure refrigerant, surface pressure against the vane rises as well, which may cause leakage between compression chambers or vibration. However, a contact force between the vanes 1351, 1352, and 1353 and the cylinder 133 can be appropriately maintained by maintaining back pressure of the back pressure chambers according to each vane. In addition, in the vane rotary compressor according to the embodiment of the present disclosure, a vibration distance of the vanes can be optimized by maintaining a minimum distance (hereinafter, referred to as 'front gap') between a front surface of each of the vanes 1351, 1352, and 1353 and the inner circumferential surface of the cylinder 133. As a result, leakage between compression chambers can be suppressed and noise and abrasion caused by vane vibration can also be suppressed. Therefore, it is possible to enhance reliability of the vane rotary compressor using the high-pressure refrigerant.

In addition, in the vane rotary compressor according to the present disclosure, a radial support force with respect to the rotation shaft can be enhanced even under a low-temperature heating condition, a high pressure ratio condition, and a high-speed operation condition. In addition, a distance between the front surface of each of the vanes 1351, 1352, and 1353 and the inner circumferential surface of the cylinder 133 is minimized to optimize the vibration distance of the vanes, thereby suppressing leakage between compression chambers and noise and abrasion caused by vane vibration.

Meanwhile, in the vane rotary compressor according to the present disclosure, as aforementioned, pressure on the front surface of the vane applied from the compression space based on the contact point of the cylinder and the roller is changed from compression pressure to suction pressure, which causes vane vibration. As a result, suction loss, compression loss, striking noise, vibration, or abrasion on the cylinder or the vane may occur.

In view of this, when back pressure is increased to suppress the vane from being pushed backwards, the front surface of the vane may be excessively adhered to the inner circumferential surface of the cylinder, resulting in increased friction loss or abrasion.

Therefore, as illustrated in the embodiment of the present disclosure, if a length of the vane is optimized to minimize the vibration distance that the vane is pushed backwards caused by difference in pressure which is applied to the vane from the compression space, a gap or interval between the vane and the cylinder can be minimized within a normal operation available range of the compressor. Thus, a refrigerant in the discharge chamber can be prevented from flowing into the suction chamber between the vane and the cylinder, thereby reducing suction loss and compression loss, reducing noise caused by vane vibration, and suppressing abrasion of the cylinder or the vane.

Figure 6:
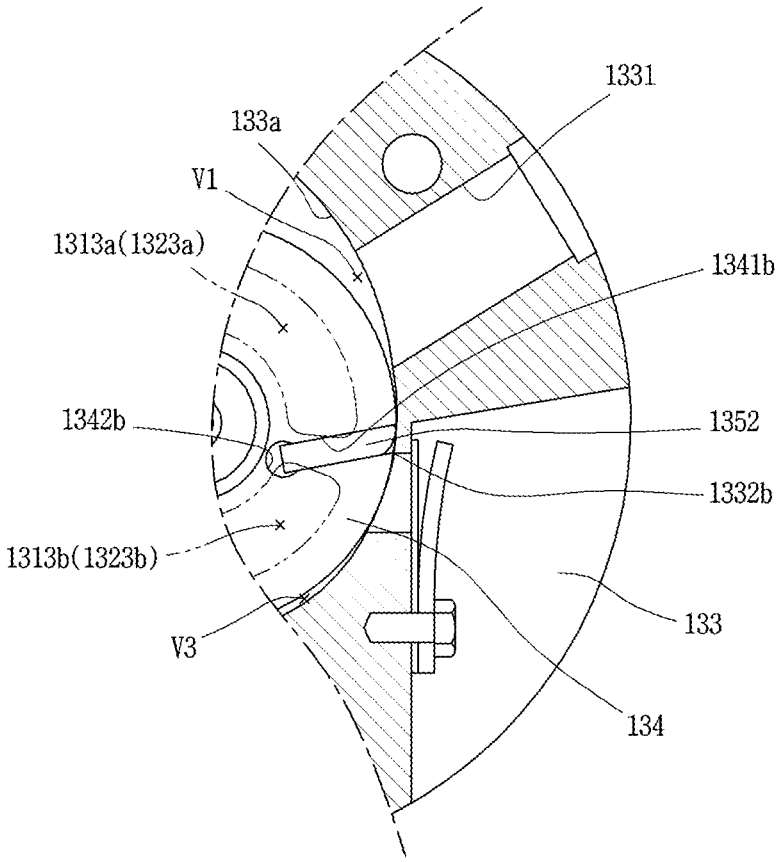
FIG. 6 is a cut sectional view of a part of a compression unit in the vane rotary compressor according to the present disclosure.
Figure 7:
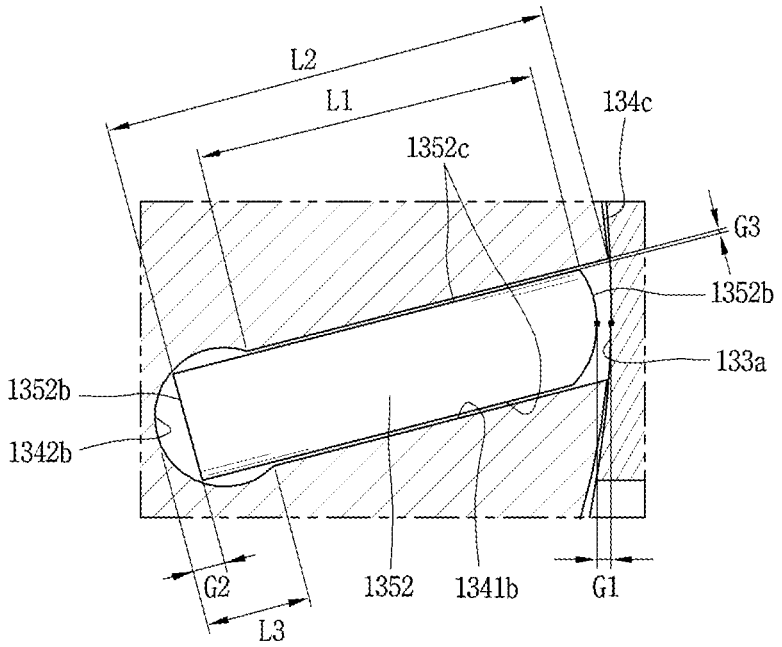
FIG. 7 is an enlarged sectional view illustrating a vane in the vicinity of a contact point for explaining a vane specification of FIG. 6.

FIG. 6 is a cut sectional view illustrating a part of the compression unit in the vane rotary compressor according to the present disclosure, and FIG. 7 is an enlarged sectional view illustrating the vane in the vicinity of the contact point for explaining a vane specification of FIG. 6. However, since the vane is rotated together with the roller, the vane adjacent to the contact point is used as a representative example for the sake of convenience. Other vanes are formed to have the same specification as well.

Referring to FIGS. 6 and 7, the cylinder 133 is provided with the inlet port 1331 and the outlet port 1332*b* based on both sides of the contact point P, and the roller 134 is provided with the vane slot 1341*b* so that the vane 1352 is slidably inserted therein. The back pressure chamber 1342*b* is formed at the rear end portion of the vane slot 1341*b* so as to communicate with the back pressure pocket [1313*a*, 1313*b*], [1323*a*, 1323*b*3].

A length L1 of the vane slot 1341*b* is formed to be shorter than a length L2 of the vane 1352. However, the back pressure chamber 1342*b* is formed at the rear side of the vane slot 1341*b*, and a combined length of an inner diameter L3 of the back pressure chamber 1342*b* and the length L1 of the vane slot 1341*b* forms to be longer than the length L2 of the vane 1352. Therefore, the vane 1352 can move forward and backward (or an inward and outward direction of the roller) inside of the vane slot 1341*b* and the back pressure chamber 1342*b*. Hereinafter, a length is defined as a length in a sliding direction of the vane, and a width is defined as a width in a circumferential direction of the roller 134.

Figure 8A:
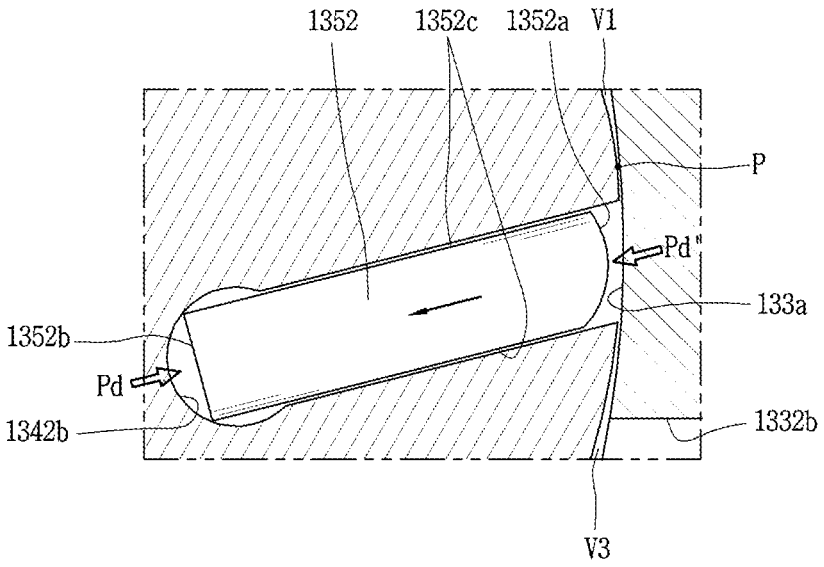
FIGS. 8A and 8B are sectional views illustrating a relation between a vane and a cylinder in response to a reciprocating motion of the vane according to an exemplary embodiment of the present disclosure.
Figure 8B:
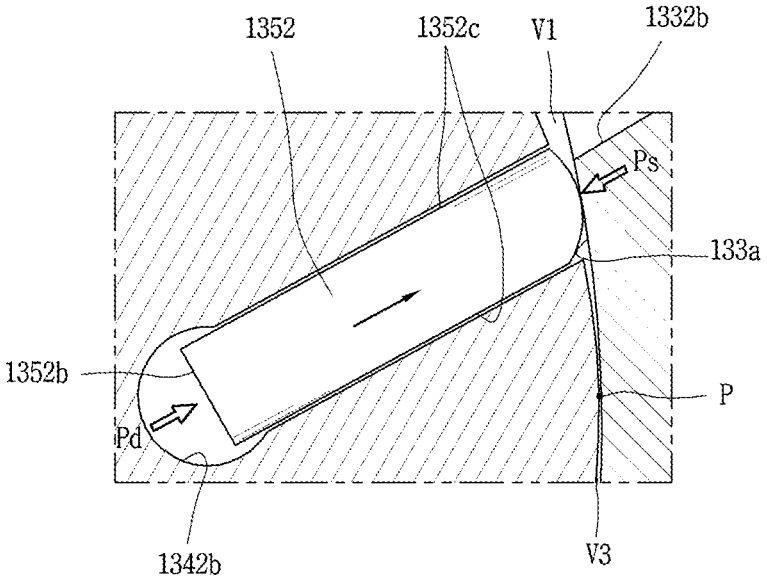

FIGS. 8A and 8B are sectional views illustrating a relation between a vane and a cylinder in response to a reciprocating motion of the vane according to an exemplary embodiment of the present disclosure.

As illustrated in 8A, when the vane 1352 passes the second outlet port 1332*b* and comes close to the contact point P, pressure [(for example, compression pressure Pd')] applied to a front surface 1352*a* of the vane 1352 is higher than back pressure Pd of the back pressure chamber 1342*b* applied to a rear surface 1352*b* of the vane 1352. Then, the vane 1352 is pushed back by the compression pressure Pd' so that the front surface 1352*a* of the vane 1352 is separated from the inner circumferential surface 133*a* of the cylinder 133. Then, the compression chambers V1 and V3 formed at both sides of the vane 1352 communicate with each other, so that compressed refrigerant leaks.

In contrast, as illustrated in FIG. 8B, when the vane 1352 passes the contact point P and comes close to the inlet port 1331, the back pressure Pd of the back pressure chamber 1342*b* applied to the rear surface 1352*b* of the vane 1352 is higher than pressure [(for example, suction pressure Ps)] applied to the front surface 1352*a* of the vane 1352. Then, the vane 1352 is pushed forward by the back pressure Pd so that the front surface 1352*b* of the vane 1352 comes into contact with the inner circumferential surface 133*a* of the cylinder 133. As a result, a space between compression chambers V1 and V3 formed at both sides of the vane 1352 are blocked and collision noise is generated.

Therefore, in the embodiment of the present disclosure, the length of the vane 1352 is limited to minimize a distance that vane 1352 is pushed back by the compression pressure Pd', that is, a vibration distance, even when the back pressure of the back pressure chamber 1342*b* applied to the rear surface 1352*b* of the vane 1352 is lower than the pressure (for example, compression pressure) applied to the front surface 1352*a* of the vane 1352, thereby minimizing a distance between the front surface of the vane and the inner circumferential surface of the cylinder. However, if the length L2 of the vane 1352 is too long, it may cause an assembly defect while coupling the roller 134 and the vane 1352 to the cylinder 133 or an increase in friction loss during operation. Therefore, the maximum length of the vane needs to be limited by taking the assembly detect and friction loss into account.

For example, when the vane 1352 according to this embodiment is located between the inlet port 1331 and the outlet port 1332*b*, and the rear surface 1335*b* of the vane 1335 facing the back pressure chamber 1342*b* is in contact with an inner circumferential surface of the back pressure chamber 1342*b*, a front gap G1 between the front surface 1352*a* of the vane 1352 and the inner circumferential surface of the cylinder 133 may be formed to be smaller than a rear gap G2 between the rear surface 1352*b* of the vane 1352 and an opposed inner surface of the back pressure chamber 1342*b*, and larger than an entire lateral gap G3 between the inner surface of the back pressure chamber 1342*b* and both side surfaces 1352*c* of the vane 1352.

Specifically, the minimum value of the front gap G1 may be greater than or equal to 10 μm, and the maximum value may be smaller than or equal to 50 μm.

Here, the minimum value of the front gap G1, as described above, is a minimum assembly gap between the cylinder 133 and the vane 1352 in consideration of a machining error or an assembly error while assembling the compressor assembly. This is determined by the inventor of the present disclosure based on several experimental results. The maximum value is a value at which abrasion between the cylinder 133 and the vane 1352 is minimized by performing an experiment under a high pressure ratio condition (for example, discharge pressure Pd of 45 bar and suction pressure Ps of 5.5 bar), which was also selected based on the results of the inventor' experiments conducted several times.

In other words, if the front gap G1 is smaller than the rear gap G2 but exceeds 50 μm, the vibration distance of the vane 1352 increases accordingly. Then, when the vane 1352 moves backwards, a gap between the vane 1352 and the cylinder 133 widens, causing an increase in leakage between compression chambers.

Also, when the vane 1352 moves forward by the increased vibration distance of the vane 1352, and collides with the cylinder 133, which increases an amount of impact generated, thereby increasing collision noise and causing abrasion on an inner circumferential surface a of the cylinder 133 or the front surface 1352*a* of the vane 1352. Therefore, the front gap G1 is preferably formed to be smaller than at least the rear gap G2, for example, smaller than or equal to 50 μm.

Figure 9:
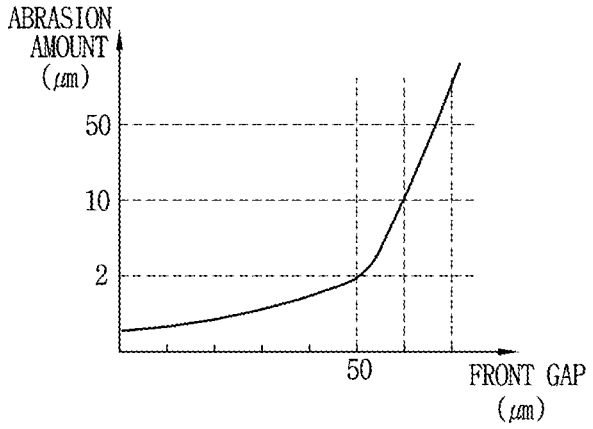
FIG. 9 is a graph illustrating changes in abrasion amount according to changes in front gap in the vane rotary compressor according to the present disclosure.
Figure 10:
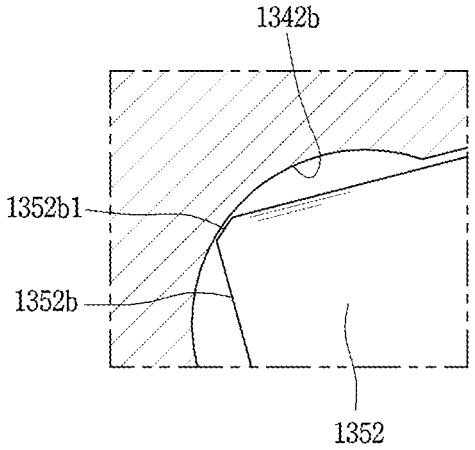
FIG. 10 is a schematic view illustrating another embodiment of a vane of FIG. 7 according to the present disclosure.

This can be seen from the results of experiments on changes in abrasion amount in FIG. 9. FIG. 9 is a graph illustrating changes in abrasion amount according to changes in front gap in the vane rotary compressor according to the embodiment of the present disclosure. Referring to this, when the front gap is approximately 50 μm or less, abrasion hardly occurs or is controlled to be approximately 2 μm or less. However, when the front gap exceeds 50 μm, the amount of abrasion begins to increase sharply. When the front gap increases to about 60 μm, then the amount of abrasion increases to about 10 to 20 μm. When the front gap becomes 70 μm, the amount of abrasion exponentially increases to approximately over 50 μm. Therefore, the front gap G1 is preferably designed to be 50 μm or less.

Further, when the front gap G1 is smaller than a lateral gap G3, for example, under assumption that the lateral gap G3 is 10 to 15 μm, the front gap G1 is almost the minimum assembly gap, which causes an assembly defect or significantly reduces a width that the vane 1352 moves forward and backward, as described above. As a result, friction loss may be increased due to viscosity of oil introduced between the vane 1352 and the cylinder 133. Therefore the front gap G1 is preferably formed to be at least 10 μm or more, that is, larger than the lateral gap G3.

Meanwhile, as the rear surface 1352*b* of the vane 1352 is formed in a circular cross-sectional shape, the rear surface 1352*b* of the vane 1352 may be formed to have a right-angled corner. In some cases, however, an anti-collision surface 1352*b*1 may be formed in a tapered shape by chamfering the corner of the rear surface 1352*b* of the vane 1352.

When the rear corner of the vane 1352 is formed to have a right angle, noise can be generated while the rear corner of the vane 1352 collides with the inner circumferential surface of the back pressure chamber 1342*b* with the circular cross-sectional shape as the vane 1352 moves backwards. On the other hand, when the anti-collision surface 1352*b*1 is formed in the tapered shape at the rear corner of the vane 1352, the collision between the vane 1352 and the back pressure chamber 1342*b* can be prevented.

Thus, the distance that the vane is pushed backwards caused by the vane vibration can be minimized by limiting the length of the vane so that the vibration distance of the vane can be minimized. This may result in minimizing the distance between the vane and the cylinder while the vane is vibrating.

Furthermore, compressed refrigerant can be prevented from leaking during the operation of the compressor by minimizing the distance between the vane and the cylinder. In addition, vibration noise and abrasion of the vane and cylinder can be reduced by reducing the amount of collision between the vane and the cylinder.

Figure 11:
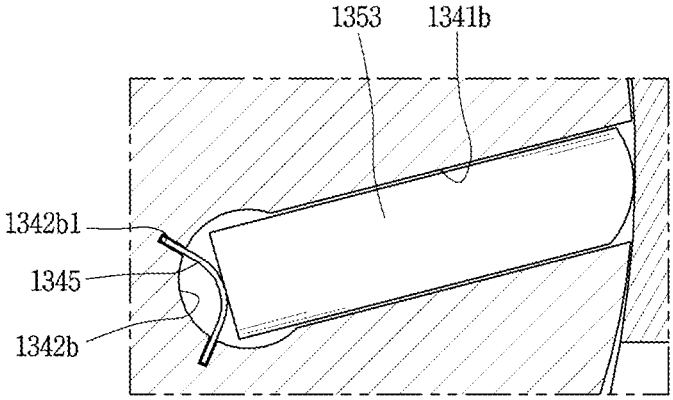
FIG. 11 is a sectional view illustrating another embodiment for minimizing a vibration distance of a vane in the vane rotary compressor according to the present disclosure.

FIG. 11 is a sectional view illustrating another embodiment for minimizing the vibration distance of the vane in the vane rotary compressor according to the present disclosure.

Referring to FIG. 11, an elastic member 1345 may be provided to elastically supporting the rear surface 1352*b* of the vane 1352 in a direction toward the inner circumferential surface 133*a* of the cylinder 133, that is, toward a front side. A compression coil spring may be used for the elastic member 1345. However, a leaf spring may alternatively be used when taking into consideration the size of the vane slot 1341*b* and its assembly operation.

For example, the elastic member 1341 implemented by the leaf spring may be fixedly inserted into an inner circumferential surface of a rear side of the back pressure chamber 1342*b*. The elastic member 1345 formed in a rectangular shape may be inserted in an axial direction.

However, when the elastic member 1345 is fixed to both side surfaces of the circumferential direction of the back pressure chamber 1342*b*, an inner space of the back pressure chamber 1342*b* may be divided into a front space and a rear space based on a reciprocating direction of the vane 1352. Then, oil introduced into the back pressure chamber 1342*b* is dispersed into the front space and the rear space, which may decrease back pressure in some cases. Accordingly, the elastic member 1345 is provided with a through hole or a through groove so that the front space and the rear space of the back pressure chamber 1342*b* communicate with each other, an axial length of the elastic member 1345 may be formed to be shorter than an axial length of the back pressure chamber, or be fixed to the back pressure chamber with predetermined spacing on both sides of an axial direction of the elastic member.

Also, the elastic member 1345 may be inserted into the back pressure chamber 1342*b* to be maintained in a semi-free state capable of moving to some extent. Or a fixing groove 1342*b*1 may be formed in a slit shape on the inner circumferential surface of the back pressure chamber 1342*b* so that the elastic member 1345 is fixedly inserted thereinto. FIG. 11 illustrates an example in which the fixing groove 1342*b*1 is formed in the back pressure chamber 1342*b* and the elastic member 1345 is inserted into the fixing groove 1342*b*1.

In addition, the elastic member 1345 may be formed in a simple rectangular shape, or may also be formed to have a central portion protruding convexly toward the vane 1352. Accordingly, contact strength between the vane 1352 and the cylinder 133 can be increased while reducing the length of the vane 1352, thereby suppressing refrigerant leakage between compression chambers. This may make the vane close to the cylinder even when discharge pressure is not formed at the start of the compressor operation, enhancing compressor efficiency.

When the elastic member 1345 is installed in the back pressure chamber 1342*b* to support the vane 1352 toward the front side, the rear side of the vane 1352 is supported by the elastic member 1345 even if the vane 1352 vibrates due to the difference between the compression pressure Pd' and the suction pressure Ps. Accordingly, the vibration distance of the vane is decreased. Therefore, refrigerant leakage caused by the vane vibration, and abrasion of the vane or cylinder caused by impact can be suppressed.

Although not shown in the drawings, the elastic member may also be installed in the vane slot. That is, the elastic member may be provided at any position as long as it can support the vane toward the front side. In this case, it is preferable that the elastic member is fixedly inserted into the vane slot. In this case, similar effects to the aforementioned effects can be provided and the length of the vane can be further reduced.

Figure 12:
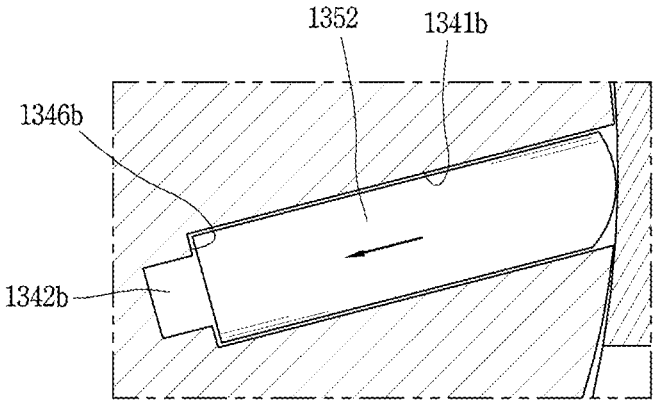
FIG. 12 is a sectional view illustrating another embodiment for limiting a vibration distance of a vane in the vane rotary compressor according to the present disclosure.

FIG. 12 is a sectional view of another embodiment for limiting the vibration distance of the vane, more specifically, limiting vibration of the rear side of the vane, in the vane rotary compressor according to the present disclosure.

Referring to FIG. 12, the vane slot or the back pressure chamber is provided with a vane stop surface 1346*b* formed in a stepped manner for restricting the vane 1352 from moving backwards. For example, the vane stop surface 1346*b* may be formed at a position between the vane slot 1341*b* and the back pressure chamber 1342*b*, that is, a position where the vane slot 1341*b* and the back pressure chamber 1342*b* are connected.

The width of the vane slot 1341*b* is formed to be larger than the width of the back pressure chamber 1342*b* so that the stepped vane stop surface 1346*b* can be formed between a rear end of the vane slot 1341*b* and a front end of the back pressure chamber 1342*b*. The back pressure chamber 1342*b* may be formed in a rectangular cross-sectional shape unlike the foregoing embodiment. However, a front surface of the back pressure chamber 1342*b*, which is in contact with the vane slot 1441*b*, is merely formed in a stepped shape, and other portions may be formed in any shape such as a circular shape or other shapes.

Accordingly, when the vane 1352 is pushed backwards by compression pressure applied on the front surface thereof, backward movement of the rear surface of the vane 1352 is restricted by the vane stop surface 1346*b* provided with a roller. As a result, the vibration distance of the vane 1352 is decreased, and the above-described effects can be achieved. However, when the vane 1352 is pushed backwards, noise may be generated as the rear surface of the vane 1352 collides with the vane stop surface 1346*b*. Thus, the vane stop surface 1346*b* may be formed to be as small as possible, or may be provided with a buffer portion in an embossed shape.

What is claimed is:

1. A vane rotary compressor, comprising:

a cylinder;

a main bearing and a sub bearing coupled to the cylinder to form a compression space together with the cylinder, wherein at least one of the main bearing and the sub bearing includes a back pressure pocket formed on a surface facing the cylinder;

a rotation shaft radially supported by the main bearing and the sub bearing;

a roller coupled to the rotation shaft and rotatably supported within the cylinder between the main bearing and the sub bearing, the roller being configured such that an outer circumferential surface of one side of the roller is positioned in close proximity with an inner circumferential surface of the cylinder at a contact point, the roller including a plurality of vane slots formed along a circumferential direction of the roller, with each of the vane slots including one end opened toward the outer circumferential surface of the roller, and a back pressure chamber formed at the opposite end of the vane slot and in fluid communication with the back pressure pocket during at least a portion of a full rotation of the roller;

a plurality of vanes slidably supported in the vane slots of the roller, and protruding in a direction toward the inner circumferential surface of the cylinder with the plurality of vanes dividing the compression space into a plurality of compression chambers, wherein the compression space is provided with an inlet port and an outlet port formed at both sides of the contact point; and an elastic member supported within the back pressure chamber of each of the vane slots and configured to support a rear surface of the respective vane slidably supported in the vane slot when the vane moves into the back pressure chamber of the vane slot, wherein the elastic member is a leaf spring, and a fixing groove is formed in a slit shape on an inner circumferential surface of the back pressure chamber of each of the vane slots, wherein a circumferential end of the elastic member is inserted into the fixing groove of the back pressure chamber, wherein the back pressure pocket is in fluid communication with the back pressure chambers of the plurality of vane slots during at least a portion of the full rotation of the roller, wherein the back pressure pocket is divided into a plurality of pockets along a circumferential direction of the at least one of the main bearing and the sub bearing, and wherein the plurality of pockets have different inner pressures, and wherein each of the plurality of pockets includes a bearing protrusion portion formed on an inner circumferential side of the pocket facing an outer circumferential surface of the rotation shaft and forming a radial bearing surface with respect to the outer circumferential surface of the rotation shaft.

2. The compressor of claim 1, wherein the fixing groove is formed at each of both circumferential sides of the back pressure chamber facing each other, and wherein both ends of the elastic member in the circumferential direction are inserted into the fixing groove, respectively.

3. The compressor of claim 2, wherein the fixing groove is inclined in opposite directions toward the rear surface of the vane, and wherein a central portion of the elastic member protrudes toward the rear surface of the vane.

4. The compressor of claim 1, wherein the elastic member is provided with a through hole or a through groove so that front and rear spaces of the elastic member communicate with each other.

5. The compressor of claim 1, wherein an axial length of the elastic member is shorter than an axial length of the back pressure chamber so that front and rear spaces of the elastic member communicate with each other.

6. The compressor of claim 1, wherein the back pressure chamber has a maximum width greater than or equal to a width of the vane slot.

7. The compressor of claim 6, wherein the inner surface of the back pressure chamber has a curved shape and the rear surface of the vane has a right-angled corner.

8. The compressor of claim 6, wherein the inner surface of the back pressure chamber has a curved shape and the vane has a rear corner chamfered to have a tapered shape.

9. The compressor of claim 1, wherein a vane of the plurality of vanes located between the inlet port and the outlet port during a rotation of the roller is configured such that a front gap between a front surface of the vane and an inner circumferential surface of the cylinder is smaller than a rear gap between a rear surface of the vane and an inner surface of the back pressure chamber facing the rear surface of the vane, and greater than a lateral gap between the inner surface of the back pressure chamber and a side surface of the vane, in a state where the rear surface of the vane facing the back pressure chamber is in contact with the inner surface of the back pressure chamber.

10. The compressor of claim 9, wherein the front gap is greater than or equal to a predetermined minimum assembly gap, and wherein the back pressure chamber has a maximum width greater than or equal to a width of the vane slot.

11. The compressor of claim 1, wherein the plurality of pockets comprises: a first pocket having a first pressure; and a second pocket having a second pressure higher than the first pressure, and wherein the bearing protrusion portion of the second pocket includes a communication flow path extending through the bearing protrusion portion and in fluid communication with an inner circumferential surface of the bearing protrusion portion facing the outer circumferential surface of the rotation shaft.

12. The compressor of claim 11, wherein at least a part of the communication flow path overlaps an oil groove formed on a radial bearing surface of one of the main bearing or the sub bearing, and wherein the communication flow path is formed as a communication groove or a communication hole.

13. The compressor of claim 12, wherein the rotation shaft includes an oil flow path formed in a central portion thereof along an axial direction, wherein the oil flow path includes an oil passage hole extending through the rotation shaft from the oil flow path to the outer circumferential surface of the rotation shaft, and wherein the oil passage hole is formed within a range of the radial bearing surface of the bearing protrusion portion.

14. A vane rotary compressor, comprising:

a cylinder;

a main bearing and a sub bearing coupled to the cylinder to form a compression space together with the cylinder, wherein each of the main bearing and the sub bearing includes a divided back pressure pocket formed on a surface facing the cylinder, the divided back pressure pocket including a first pocket having a first inner pressure and a second pocket having a second inner pressure higher than the first inner pressure;

a rotation shaft radially supported by the main bearing and the sub bearing;

a roller rotatably supported within the cylinder between the main bearing and the sub bearing, the roller being configured such that an outer circumferential surface of one side of the roller is positioned in close proximity with an inner circumferential surface of the cylinder at a contact point, the roller including a plurality of vane slots formed along a circumferential direction of the roller, with each of the vane slots including one end opened toward the outer circumferential surface of the roller, and a back pressure chamber formed at the opposite end of the vane slot and in fluid communication with the divided back pressure pocket; and a plurality of vanes slidably supported in the vane slots of the roller, and protruding in a direction toward the inner circumferential surface of the cylinder with the plurality of vanes dividing the compression space into a plurality of compression chambers, wherein the compression space is provided with an inlet port and an outlet port formed at both sides of the contact point, wherein each of the vane slots includes a stepped portion adjacent to the back pressure chamber, wherein the stepped portion forms a vane stop surface configured to restrict the vane from moving backwards into the back pressure chamber in contact with the rear surface of the vane when a compression chamber formed ahead of the vane slidably supported in the vane slot in a direction of rotation of the roller is at its highest pressure prior to discharge of fluid from the compression chamber through the outlet port, and wherein each of the first and second pockets includes a bearing protrusion portion formed on an inner circumferential side of the pocket and forming a radial bearing surface with respect to the outer circumferential surface of the rotation shaft.

15. The compressor of claim 14, wherein a width of the back pressure chamber is less than a width of the vane slot so that the stepped portion defining the vane stop surface is formed between a front end of the back pressure chamber and a rear end of the vane slot.

16. The compressor of claim 15, wherein during rotation of the roller each of the vanes located at a position between the inlet port and the outlet port is configured such that a front gap between a front surface of the vane and an inner circumferential surface of the cylinder is smaller than a rear gap between a rear surface of the vane and an inner surface of the back pressure chamber facing the rear surface of the vane, and the front gap is larger than a lateral gap between a side of the inner surface of the back pressure chamber and a side surface of the vane.

17. The compressor of claim 14, wherein the bearing protrusion portion of the second pocket includes a communication flow path extending through the bearing protrusion portion and in fluid communication with an inner circumferential surface of the bearing protrusion portion facing the outer circumferential surface of the rotation shaft, and wherein at least a part of the communication flow path overlaps an oil groove formed on a radial bearing surface of one of the main bearing or the sub bearing.

18. The compressor of claim 17, wherein the rotation shaft includes an oil flow path formed in a central portion thereof along an axial direction, wherein the oil flow path includes an oil passage hole extending through the rotation shaft from the oil flow path to the outer circumferential surface of the rotation shaft, and wherein the oil passage hole is formed within a range of the radial bearing surface of the bearing protrusion portion.

* * * * *